US007052100B2

(12) United States Patent
Otsuki

(10) Patent No.: US 7,052,100 B2
(45) Date of Patent: May 30, 2006

(54) CORRECTION OF POSITIONAL DEVIATION IN BI-DIRECTIONAL PRINTING DEPENDING ON PLATEN GAP

(75) Inventor: Koichi Otsuki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 294 days.

(21) Appl. No.: 10/677,478

(22) Filed: Oct. 3, 2003

(65) Prior Publication Data

US 2004/0223017 A1 Nov. 11, 2004

(30) Foreign Application Priority Data

Oct. 3, 2002 (JP) ..... 2002-291253

(51) Int. Cl.
*B41J 29/38* (2006.01)
*B41J 29/393* (2006.01)

(52) U.S. Cl. ..... 347/16; 347/19

(58) Field of Classification Search ..... 347/8, 347/14, 19, 37

See application file for complete search history.

(56) References Cited

U.S. PATENT DOCUMENTS 5,518,324 A * 5/1996 Campbell et al. ..... 400/56
5,644,344 A * 7/1997 Haselby ..... 347/19
5,988,784 A * 11/1999 Takemura et al. ..... 347/8
6,364,447 B1 * 4/2002 Boleda et al. ..... 347/19
6,666,537 B1 * 12/2003 Kelley et al. ..... 347/8

FOREIGN PATENT DOCUMENTS

JP 05-069625 A 3/1993
JP 2000-203091 A 7/2000
JP 2000-218868 A 8/2000
JP 2000-334936 A 12/2000

* cited by examiner

*Primary Examiner*—Thinh Nguyen
(74) *Attorney, Agent, or Firm*—Sughrue Mion, PLLC

(57) ABSTRACT

A platen gap between a print head and a platen can be adjusted into a plurality of values. Different correction values of bi-directional printing misalignment, δG1 and δG2, which are respectively associated with a plurality of values of the platen gap, PG1 and PG2, are stored in the EEPROM 200 for use in correcting positional deviation of ink dots in bi-directional printing. A positional deviation correction section 212 selects a positional deviation correction value based on at least the value of the platen gap, and corrects the positional deviation of ink dots in bi-directional printing using the selected positional deviation correction value.

9 Claims, 13 Drawing Sheets

Fig.4

PLATEN GAP AND BI-DIRECTIONAL PRINTING MISALIGNMENT CORRECTION VALUE (FIRST EMBODIMENT)

| PRINT MODE | PRINT MEDIUM | PLATEN GAP PG | PRINT RESOLUTION (MAIN SCAN × SUB SCAN) | CARRIAGE SPEED | MONOCHROME /COLOR | BI-DIRECTIONAL PRINT CORRECTION VALUE δ |
|---|---|---|---|---|---|---|
| 1 | PHOTO PRINT PAPER | PG1 = 0.9mm | 720×720 dpi | 240 cps | MONOCHROME | δ G1m1 |
| 2 | | | | | COLOR | δ G1c1 |
| 3 | | | 1440×720 dpi | 240 cps | MONOCHROME | δ G1m2 |
| 4 | | | | | COLOR | δ G1c2 |
| 5 | | | 2880×1440 dpi | 200 cps | MONOCHROME | δ G1m3 |
| 6 | | | | | COLOR | δ G1c3 |
| 7 | REGULAR PAPER | PG2 = 1.5mm | 720×720 dpi | 240 cps | MONOCHROME | δ G2m1 |
| 8 | | | | | COLOR | δ G2c1 |
| 9 | | | 1440×720 dpi | 240 cps | MONOCHROME | δ G2m2 |
| 10 | | | | | COLOR | δ G2c2 |
| - | | | 2880×1440 dpi | 200 cps | MONOCHROME | - |
| - | | | | | COLOR | - |

Each correction value is set based on test pattern suitable for each mode.

Fig.6
TEST PATTERN WITH COLOR PATCHES
FOR BI-DIRECTIONAL PRINT MISALIGNMENT
CORRECTION VALUE NUMBER=1
(CORRECTION VALUE $\delta$=0)
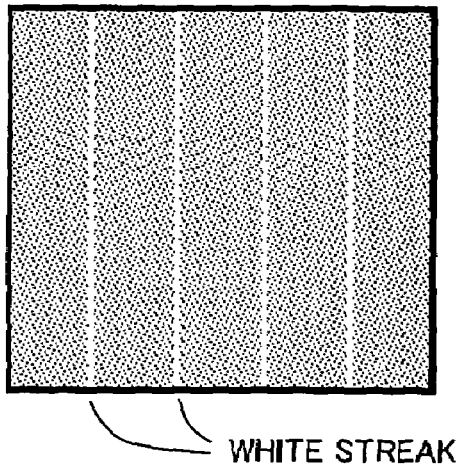
CORRECTION VALUE NUMBER=2
(CORRECTION VALUE $\delta$=1)
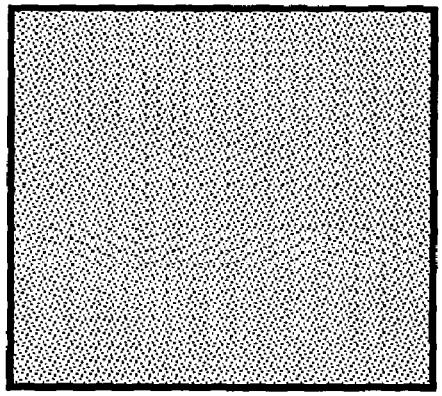
CORRECTION VALUE NUMBER=3
(CORRECTION VALUE $\delta$=2)
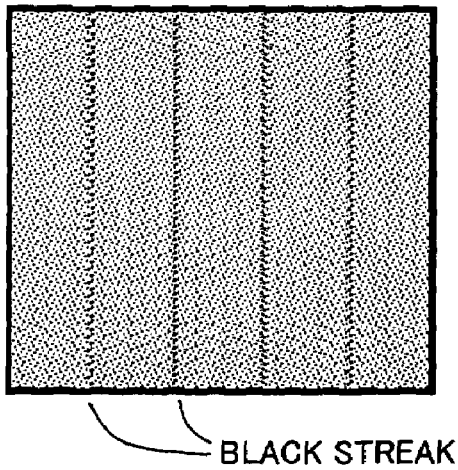

TEST PATTERN WITH VERTICAL RULED LINES FOR BI-DIRECTIONAL PRINT MISALIGNMENT

Fig.11

ADJUSTMENT OF MISALIGNMENT CORRECTION VALUE

| PRINT MODE | PRINT MEDIUM | PLATEN GAP PG | PRINT RESOLUTION (MAIN SCAN × SUB SCAN) | CARRIAGE SPEED | MONOCHROME/ COLOR | CORRECTION VALUE δ IN BI-DIRECTIONAL PRINTING |
|---|---|---|---|---|---|---|
| 1 | PHOTO PRINT PAPER | PG1 = 0.9mm | 720×720 dpi | 240 cps | MONOCHROME | δG1m1 |
| 2 | | | | | COLOR | δG1c1 |
| 3 | | | 1440×720 dpi | 240 cps | MONOCHROME | δG1m2 |
| 4 | | | | | COLOR | δG1c2 |
| 5 | | | 2880×1440 dpi | 200 cps | MONOCHROME | δG1m3 |
| 6 | | | | | COLOR | δG1c3 |
| 7 | REGULAR PAPER | PG2 = 1.5mm | 720×720 dpi | 240 cps | MONOCHROME | δG2m1 |
| 8 | | | | | COLOR | δG2c1 |
| 9 | | | 1440×720 dpi | 240 cps | MONOCHROME | δG2m2 |
| 10 | | | | | COLOR | δG2c2 |
| – | | | 2880×1440 dpi | 200 cps | MONOCHROME | – |
| – | | | | | COLOR | – |

Change

δG1m1 → δG1m1'

Adjustment

In response to change from δg1m1 to δg1m1', correction values for bi-directional print modes which have the same platen gap PG and carriage speed are changed as follows;

$\delta G1c1' \leftarrow \delta G1c1 + (\delta G1m1' - \delta G1m1)$ $\delta G1m2' \leftarrow \delta G1m2 + (\delta G1m1' - \delta G1m1)$ $\delta G1c2' \leftarrow \delta G1c2 + (\delta G1m1' - \delta G1m1)$

Fig.13

PLATEN GAP AND BI-DIRECTIONAL PRINT MISALIGNMENT CORRECTION VALUE (SECOND EMBODIMENT)

| PRINT MODE | PRINT MEDIUM | PLATEN GAP PG | PRINT RESOLUTION (MAIN SCAN × SUB SCAN) | CARRIAGE SPEED | MONOCHROME /COLOR | BI-DIRECTIONAL PRINT CORRECTION VALUE δ |
|---|---|---|---|---|---|---|
| 1 | PHOTO PRINT PAPER | PG1 = 0.9mm | 720×720 dpi | 240 cps | MONOCHROME | δ G1m1 |
| 2 | | | | | COLOR | δ G1c1 |
| 3 | | | 1440×720 dpi | 240 cps | MONOCHROME | δ G1m2 |
| 4 | | | | | COLOR | δ G1c2 |
| 5 | | | 2880×1440 dpi | 200 cps | MONOCHROME | δ G1m3 |
| 6 | | | | | COLOR | δ G1c3 |
| 7 | REGULAR PAPER | PG2 = 1.5mm | 720×720 dpi | 240 cps | MONOCHROME | δ G2m1 |
| 8 | | | | | COLOR | δ G2c1 |
| 9 | | | 1440×720 dpi | 240 cps | MONOCHROME | δ G2m2 |
| 10 | | | | | COLOR | δ G2c2 |
| – | | | 2880×1440 dpi | 200 cps | MONOCHROME | – |
| – | | | | | COLOR | – |

Set with test pattern

Estimated correction values $$\delta G2c1 = \delta G1c1 + (\delta G2m1 - \delta G1m1)$$
$$\delta G2c2 = \delta G1c2 + (\delta G2m2 - \delta G1m2)$$

CORRECTION OF POSITIONAL DEVIATION IN BI-DIRECTIONAL PRINTING DEPENDING ON PLATEN GAP

BACKGROUND OF THE INVENTION

1. Field of the Invention

This invention relates to a technique for correcting positional deviation of ink dots during bi-directional printing using a printing apparatus capable of adjusting a platen gap.

2. Description of the Related Art

Recently, ink jet printers have become widely used as computer output devices. Some ink jet printers can perform so-called "bi-directional printing" to increase the printing speed.

A problem that readily arises in bi-directional printing is that of positional deviation of ink dots between forward and backward passes in the main scanning direction, which is resulted from, for example, backlash of main scanning driving mechanism and warping of a platen. As well known in the art, there is a technique for solving such problem of positional deviation, for example, as discussed in JP5-69625A disclosed by the present applicant. In this technique an amount of positional deviation (printing misalignment) is prestored so as to correct the dot positions during forward and backward passes based on the amount of positional deviation.

Several types of print media, such as regular paper and photo print paper, are available for inkjet printers. Each type of print medium has significantly different amount of deflection (referred to as "cockling") due to absorption of ink. For this reason, a value of a platen gap has been set large enough to avoid contact between a print head and paper that is deflected due to the cockling. The setting of the platen gap to such a large value, however, undesirably increases influence of print head alignment on the ink dot positions on the print medium. Therefore, ink jet printers which can adjust the platen gap according to the type of print medium are recently proposed.

However, little consideration has been given regarding how to correct positional deviation of ink dots during bi-directional printing using a printer with adjustable platen gap.

SUMMARY OF THE INVENTION

An object of the present invention is thus to provide a technique of correcting positional deviation of ink dots during bi-directional printing using a printing apparatus with adjustable platen gap.

To achieve the above object, the present invention is directed to a printing apparatus that is capable of bi-directional printing and has a print bead and a platen gap. This printing apparatus comprises: a platen gap adjuster that is capable of adjusting a platen gap between the print head and the platen into a plurality of values; a storage that stores different positional deviation correction values for a plurality of values of the platen gap, wherein the plate gap is to be used for correcting positional deviation of ink dots in bi-directional printing; and a positional deviation correction section that selects a positional deviation correction value based on at least the value of the platen gap, and corrects the positional deviation of ink dots in bi-directional printing by using the selected positional deviation correction value.

In accordance with the present printing apparatus, the storing of different positional deviation correction values for the plurality of values of the platen gap and the use of a selected positional deviation correction value that has been selected according to the value of the platen gap effects proper correction of positional deviation, according to the platen gap during actual printing operation.

The present invention may be achieved in a variety of forms, such as a method and an apparatus for correcting positional deviation of ink dots in bi-directional printing, a method and a device for controlling bi-directional printing, a printing method and a printing apparatus, a printing controller and a method for controlling a printing apparatus, a computer program implementing the functions of those methods and devices; a recording medium in which such a computer program is recorded, and a data signal embodied in a carrier wave including such a computer program.

These and other objectives, features, aspects, and advantages of the present invention will become more apparent from the following description of the preferred embodiments with the accompanying drawings.

BRIEF DESCRIPTION OF THE DRAWING

FIG. 4 is an exemplified schematic diagram illustrating bi-directional printing misalignment correction values stored in the EEPROM 200.

FIG. 6 shows an example of test pattern with color patches.

FIG. 11 is an exemplified schematic diagram illustrating a process of adjusting other correction values when the user changes one of the correction values.

FIG. 13 is an exemplified schematic diagram illustrating a process of estimating bi-directional printing misalignment correction values in accordance with the second embodiment.

DESCRIPTION OF THE PREFERRED EMBODIMENTS

Some modes of the present invention are described below through embodiments in the following sequence.

A. General Structure of Apparatus

Figure 1:
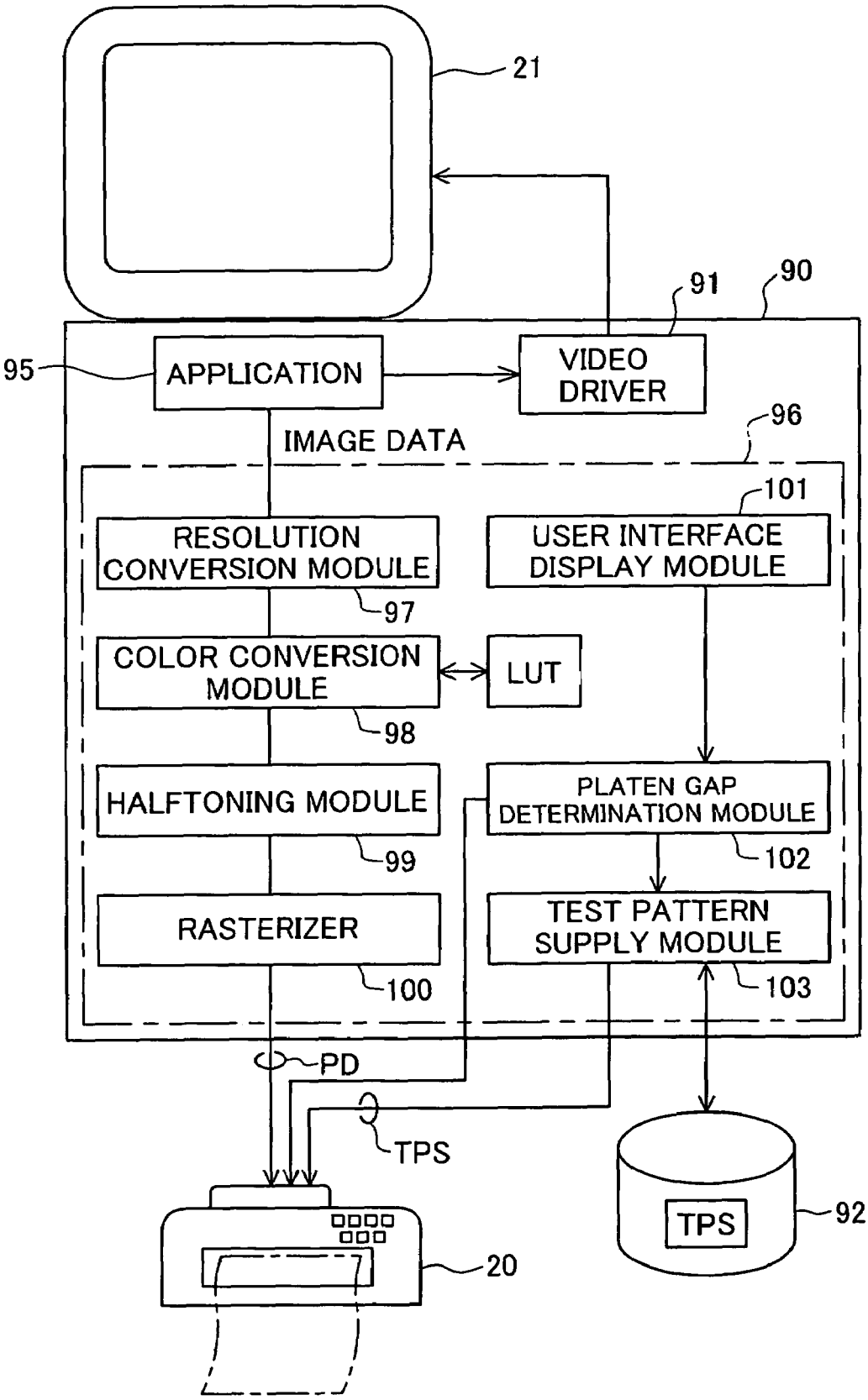
FIG. 1 is a block diagram illustrating the configuration of a printing system as one embodiment of the present invention.

B. First Embodiment of Positional Deviation Correction in Bi-directional Printing C. Second Embodiment of Positional Deviation Correction in Bi-directional Printing D. Modifications A. General Structure of Apparatus FIG. 1 is a block diagram illustrating the configuration of a printing system as one embodiment of the present invention. This printing system includes a computer 90 and a color ink jet printer 20. The printing system that includes the printer 20 and the computer 90 may be referred to as "printing apparatus" in the broad sense.

The computer 90 includes application program 95 running on a predetermined operating system. A video driver 91 and a printer driver 96 are incorporated in the operating system, and the application program 95 outputs print data PD to be forwarded to the printer 20 via these drivers. The application program 95 performs required processing on a target image, and displays a resulting image on a CRT 21 via the video driver 91.

Once the application program 95 issues a printing instruction, the printer driver 96 in the computer 90 receives image data from the application program 95 and then converts the image data into print data PD to be transmitted to the printer 20. The printer driver 96 has various modules for creating the print data PD, including a resolution conversion module 97, a color conversion module 98, halftoning module 99, a rasterizer 100 and a color look-up table LUT.

The resolution conversion module 97 functions to convert the resolution of the color image data created in the application program 95 into the print resolution. Such resolution-converted image data still remains image information consisting of three color components, R, G, and B. With reference to the color conversion look-up table LUT, the color conversion module 98 converts resulting RGB image data into multi-tone data for multicolor inks that is available for the printer 20, on a pixel to pixel basis.

The color-converted multi-tone data has, for example, tone values of 256 tones. The halftoning module 99 performs so-called halftone process to create halftone image data. The halftone-processed image data are rearranged by the rastrizer 100 in the order of the data to be transferred to the printer 20, and are then to be output as the final print data PD. The print data PD includes raster data representing the states of formation of dots during respective main scans, and data representing the feed amount in sub scanning direction.

The printer driver 96 further includes an user interface display module 101, a platen gap determination module 102 and a test pattern supply module 103. The user interface display module 101 functions to display various types of user interface windows relating to printing, and receive input data by users through those windows. The user may set various print parameters through user interface. Examples of such print parameter include the type of print medium, selection from monochrome printing and color printing, selection from uni-directional printing and bi-directional printing, and the print resolution.

The platen gap determination module 102 determines the value of the platen gap based on the selected printing condition and inform the printer 20 of the value. Details about the value of the platen gap associated with the printing condition will be described later.

The test pattern supply module 103 functions to read out a test pattern print signal TPS representing a test pattern from a hard disk 92 and transmits the signal to the printer 20. This test pattern is used for selecting the correction value for positional deviation (also referred to as "bi-directional printing misalignment") of ink dots in the main scanning direction in bi-directional printing.

The program for implementing the functions of respective modules in the printer driver 96 is stored and provided on a computer readable recording medium. Such recording medium may include a variety of computer-readable media such as flexible disk, CD-ROM, magneto-optics disc, IC card, ROM cartridge, punched card, print with barcodes or other codes printed thereon, internal storage device (memory such as RAM and ROM) and external storage device of the computer, and the like. It is also possible to download such computer program to the computer 90 via the internet.

The computer 90 incorporating the printer driver 96 acts as a print controller that causes the printer 20 to perform printing by providing the printer 20 with the print data PD and the test pattern print signal TPS. Furthermore, the computer 90 may act as a print controller that functions to determine the value of the platen gap associated with the printing condition and select a correction value for bi-directional printing misalignment according to the platen gap value. In the case that the computer 90 implements the function of selecting a correction value for bi-directional printing misalignment according to the platen gap value, it is preferable to prestore different correction values for a plurality of platen gap values in the hard disk 92.

Figure 2:
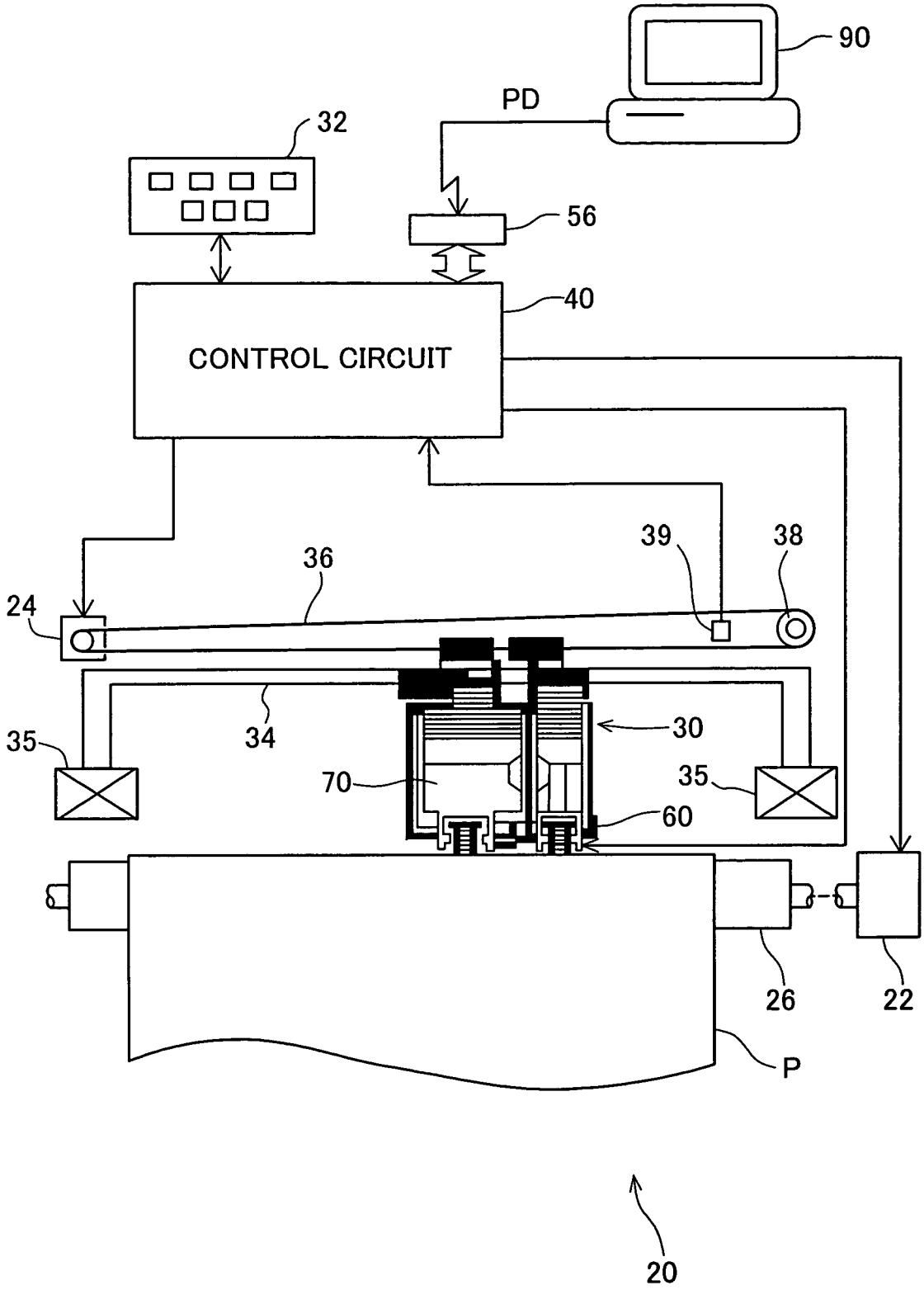
FIG. 2 schematically illustrates the configuration of the color printer 20.

FIG. 2 schematically illustrates the configuration of the color printer 20. The color printer 20 includes a sub scanning mechanism for feeding a printing medium P in the sub scanning direction by means of a paper feed motor 22, a main scanning mechanism for reciprocating a carriage 30 in the axial direction (main scanning direction) of a platen 26 by means of a carriage motor 24, a head drive mechanism for driving a print head unit 60 (also referred to as a "print head assembly") mounted on the carriage 30 to control ink ejection and dot formation, and a control circuit 40 for controlling exchange of signals with a print head unit 60 and an operation panel 32. The control circuit 40 is connected with the computer 90 via connectors 56.

The sub scanning mechanism for feeding the print medium P includes a gear train (not shown) for transmitting rotations of the paper feed motor 22 to the platen 26 and a paper feed roller (not shown). The main scanning mechanism for reciprocating the carriage 30 includes a slide shaft 34 disposed parallel to the axis of the platen 26, which slidably supports the carriage 30, a pulley 38 connected to the carriage motor 24 by an endless drive belt, and a position sensor 39 for detecting a starting position of the carriage 30.

The slide shaft 34 can move up and down by means of a slide shaft movement motor 35. Moving up and down enables the movement of the print head unit 60 relative to the platen 26, and thus adjusts the platen gap, which is the interval between the bottom surface of the print head and the platen 26. The platen gap is adjusted in response to a signal that is provided by the platen gap determination module 102 (FIG. 1). This signal may be included in the print data PD, or may be configured as a separate signal.

Figure 3:
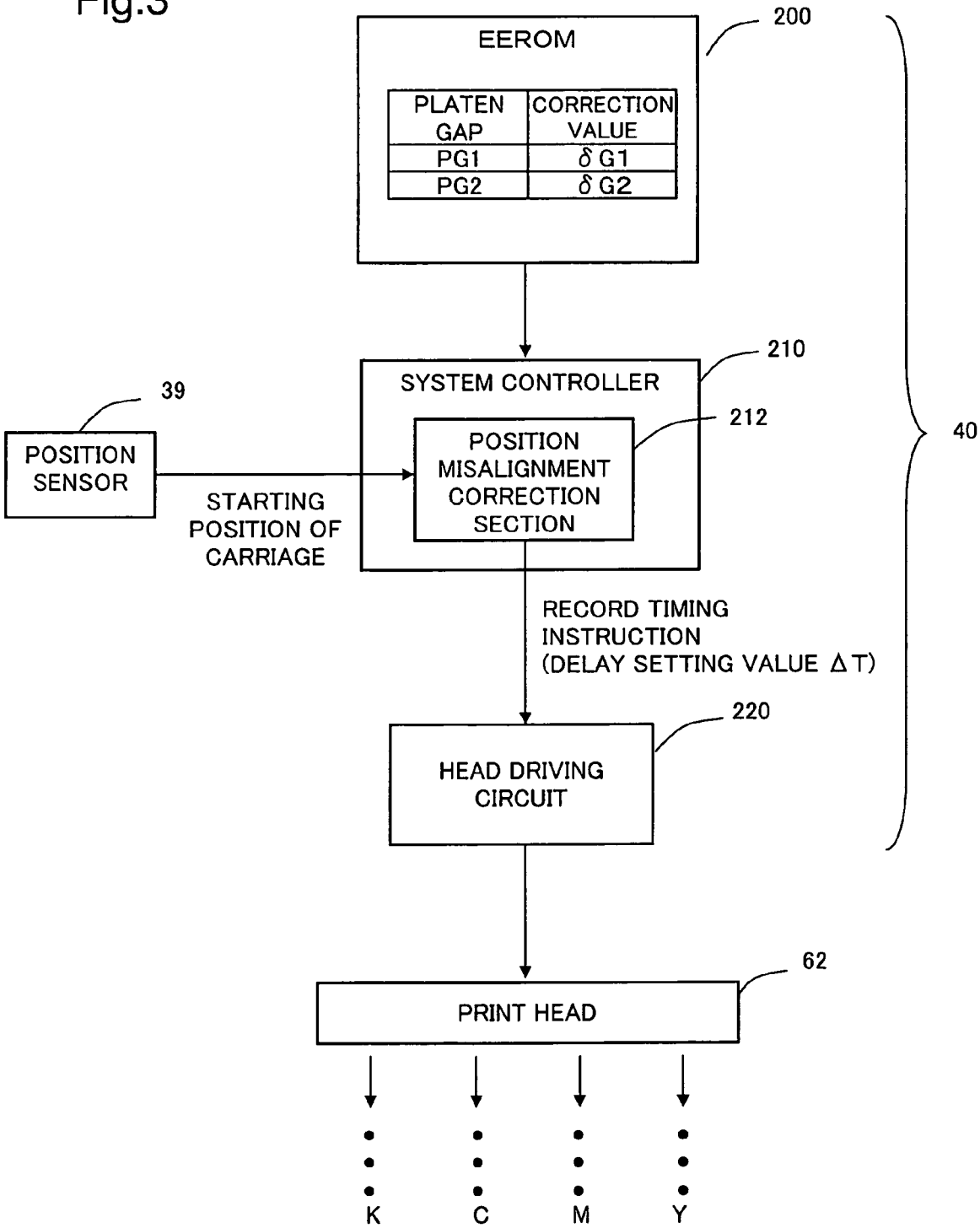
FIG. 3 is a block diagram illustrating main structure regarding correction of bi-directional printing misalignment.

FIG. 3 is a block diagram illustrating main structure regarding correction of bi-directional printing misalignment. The control circuit 40 in the printer 20 includes an EEPROM 200, a system controller 210 and a head drive circuit 220. EEPROM 200 stores different correction values for bi-directional printing misalignment δG1 and δG2 with respect to platen gap values PG1 and PG2. Details of those correction values δG1 and 8G2 will be discussed later.

The system controller 210 acts as a positional deviation correction section 212 for correcting bi-directional printing misalignment. Once the platen gap has been selected, the corresponding correction value for bi-directional printing misalignment is read out from the EEPROM 200 to be transmitted to the positional deviation correction section 212. Upon receiving a signal representing a starting position of a carriage 28 from the position sensor 39 on backward passes, the positional deviation correction section 212 provides the head drive circuit 220 with a signal for instructing recording timing of the head (delay amount setting value ΔT) based on the correction value for bi-directional printing positional deviation. The head drive circuit 220 supplies driving signals to respective nozzles installed on the print head 62, and adjusts the recording position on backward passes in response to the recording timing (i.e. delay amount setting value ΔT), which is supplied from the positional deviation correction section 212. This arrangement ensures the adjustment of recording positions of a plurality of nozzle arrays during backward passes with a single correction value. In the example shown in FIG. 3, four nozzle arrays for emitting inks of four colors, black (K), cyan (C), magenta (M) and yellow (Y), are installed on the bottom surface of the print head 62. There may be, however, used any other arrangements of nozzles.

FIG. 4 illustrates an example of correction values for bi-directional printing misalignment stored in the EEPROM 200. In this example, the correction values for bi-directional printing misalignment are preset associated with ten types of bi-directional printing modes, which are defined by combinations of a plurality of print parameters. In this specification, the terms "printing mode" and "printing condition" have the same meaning.

The user can set three types of print parameters among various print parameters in FIG. 4: the type of a print medium, the print resolution and selection from monochrome printing and color printing. Other print parameters (the platen gap and the carriage speed) are automatically selected relative to these user-settable parameters. The value of the platen gap PG is to be set to a relatively small first value PG1 (=0.9 mm) when photo print paper is used for printing, and to a relatively large second value PG2 (=1.5 mm) when regular paper is used. The carriage speed is selected relative to the print resolution.

The print resolution for photo print paper may be set to any one of 720×720 dpi, 720×720 dpi and 2880×1440 dpi. In this specification, the print resolution is represented as "(print resolution in the main scanning direction)×(print resolution in the sub scanning direction)." The higher print resolution achieves the higher picture quality, while the lower print resolution achieves the higher-speed processing. For relatively small print resolution of 720×720 dpi and 1440×720 dpi, the carriage speed is to be set to 240 cps. Here, the term "carriage speed" represents "main scanning speed" during printing, and the unit "cps" indicates "characters per second." The carriage speed is set to 200 cps for the highest print resolution, 2880×1440 dpi, which results in printing at lower speed than the other two. In this example, the highest print resolution(2880×1440 dpi) is not allowed when regular paper is used because the highest resolution printing on regular paper may cause ink bleed, thereby decreasing enhanced picture quality.

Different positional deviation correction values are used for monochrome printing and color printing, respectively. As a result, correction values for monochrome printing and color printing ΔG1m1–ΔG1m3 and ΔG1c1–ΔG1c3 for the use of photo print paper are stored respectively in the EEPROM 200 associated with three types of print resolution. Other correction values for monochrome printing and color printing ΔG2m1–ΔG2m2 and ΔG2c1–ΔG1c2 for the use of regular paper are stored respectively in the EEPROM 200 associated with two types of print resolution. In the first embodiment as described below, the correction value for each bi-directional printing mode is set using a test pattern suitable for each mode.

B. First Embodiment of Positional Deviation Correction in Bi-directional Printing As described below, correction values for bi-directional printing misalignment are preset before the printer 20 is shipped, and can be adjusted by the user after shipping.

Figure 5:
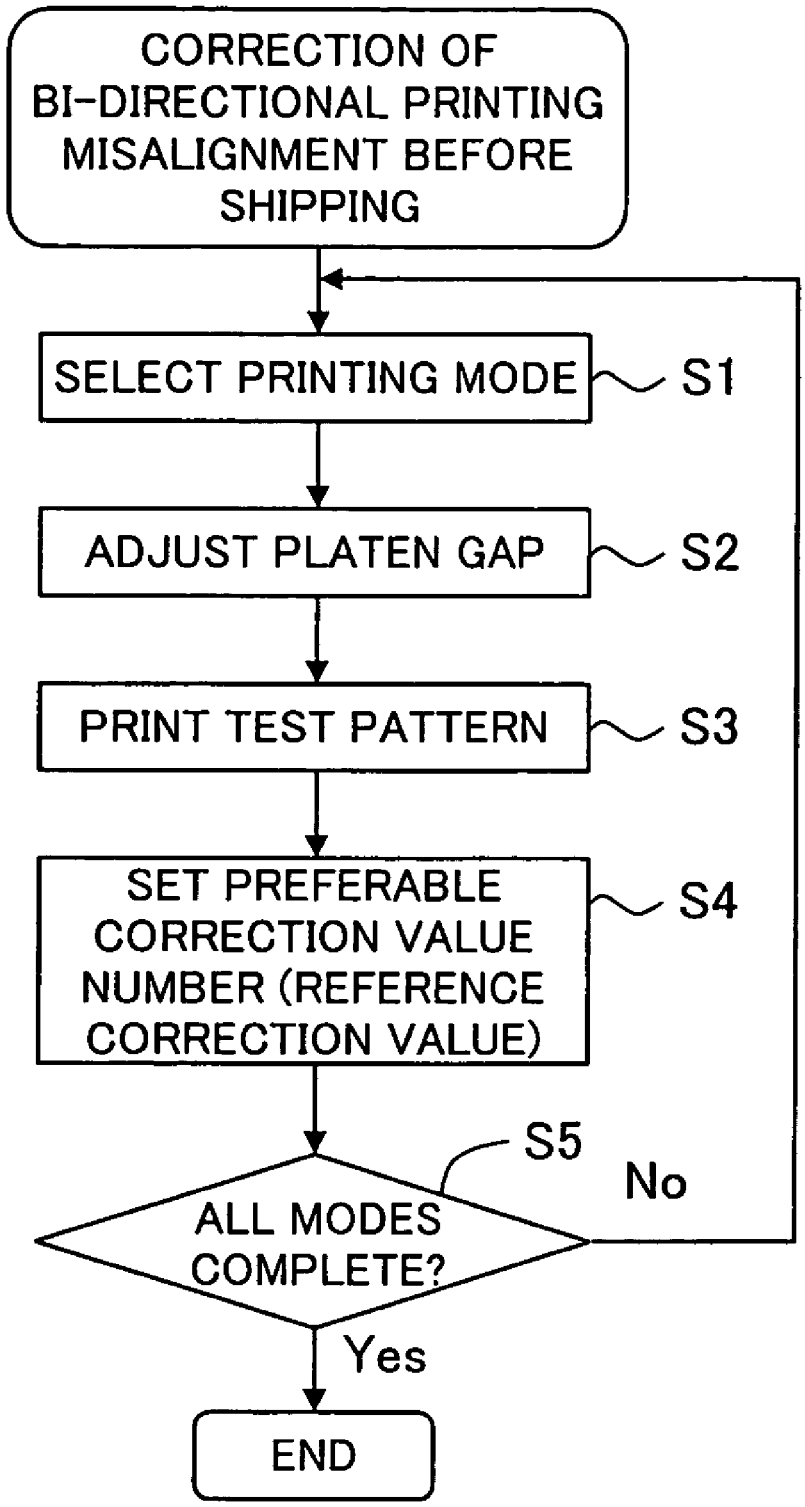
FIG. 5 is a flow chart illustrating a process of correcting bi-directional printing misalignment before the printer 20 is shipped.

FIG. 5 is a flow chart illustrating a process of correcting bi-directional printing misalignment before the printer 20 is shipped. In step S1, ten types of bi-directional printing modes (FIG. 4) to be used in the printer 20 are sequentially selected one by one. In step S2, the platen gap determination module 102 determines the platen gap value based on the selected bi-directional printing mode, and provides the printer 20 with a signal representing the platen gap value. In response to this signal, the printer 20 uses the slide shaft movement motor 35 to adjust the platen gap, if necessary. The printer 20 automatically performs this adjustment.

In step S3, a test pattern is printed out according to the selected bi-directional printing mode. FIG. 6 shows an example of a test pattern with color patches. This example shows a test pattern including three color patches associated with different positional deviation correction values δ. Correction value numbers (also referred to as "patch numbers"), which are printed next to respective color patches, are related in advance with the positional deviation correction values δ, respectively. Those positional deviation correction values δ are, however, illustrated herein for convenience of explanation and are thus not actually printed herein. Each color patch is a grey patch that reproduces grey area with uniform density in composite black using C, M, and Y inks. Such grey patch reflects both bi-directional printing misalignment and deviation between dots of respective colors. From the view point of enhancing picture quality, it is preferable to use grey patches reproduced in composite black as a test pattern because the actual picture quality of prints are influenced by the deviation between dots of respective colors as well as the bi-directional printing misalignment.

Various types of test patterns, however, may be applied such as a test pattern using any other type of color patches. The term "color patch" in this specification indicates an image area reproduced in substantially uniform color.

Figure 7:
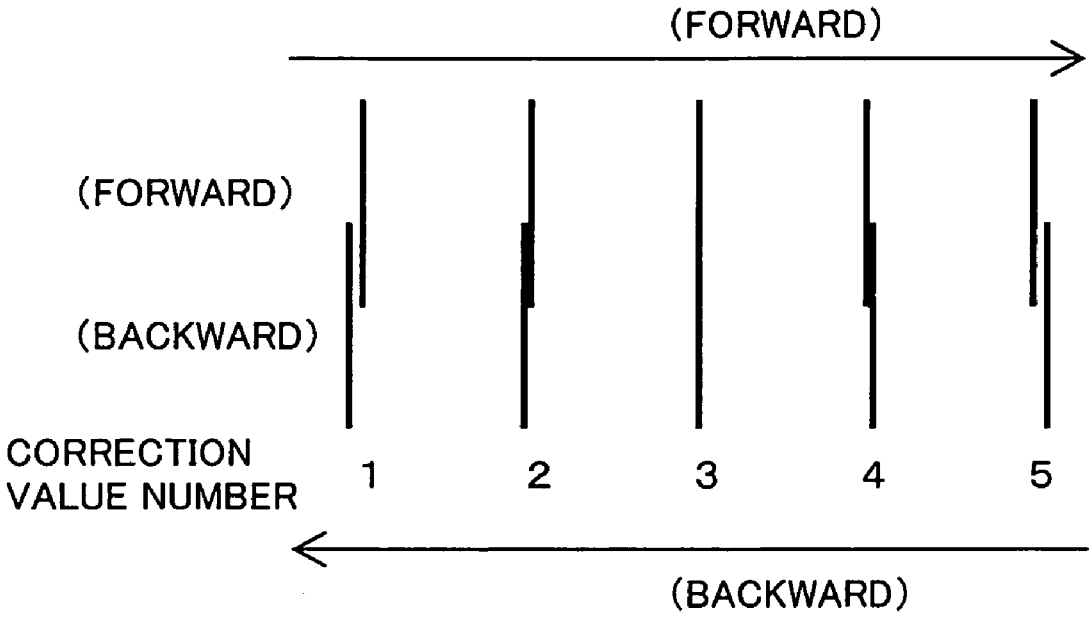
FIG. 7 shows an example of test pattern with vertical ruled lines.

FIG. 7 shows an example of test pattern using vertical ruled lines. In this test pattern, plural pairs of ruled lines, which are respectively recorded in forward and backward passes, are printed. The recording timing during backward pass is different among each pair of ruled lines by a certain amount. This difference of the recording timing corresponds to respective correction value numbers (i.e. correction values for positional deviation).

The test pattern may be of color-patch type as shown in FIG. 6, or may be of ruled-line type as shown in FIG. 7. In one example, the test pattern of ruled-line type in FIG. 7 is applied to setting of a correction value for monochrome printing, while that of color-patch type in FIG. 6 is applied to setting of a correction value for color printing. Some examples using the test pattern of color-patch type are mainly described below.

In step S4 of FIG. 5, the color patch with the highest image quality is selected among a plurality of printed color patches, and the correction value δ corresponding to the correction value number of the color patch is stored in the EEPROM 200 (FIG. 3) in the printer 20. In the example of FIG. 6, the color patch at the top of the page includes white streaks while the one at the bottom of the page includes black streaks. The color patch in the middle is free from such picture quality deterioration, and the correction value δ corresponding to the correction value number of, this color patch is to be stored in the EEPROM 200. The correction value preset by the examination before shipping is also referred to as "reference correction value".

In step S5, it is judged whether or not steps S1–S4 have been completed for all bi-directional printing modes which are designed to be used in the printer 20. If not completed, the process is returned to step S1. The term "all bi-directional printing modes which are designed to be used in the printer 20" indicates any type of bi-directional printing mode that is settable by the user through a user interface window of the printer driver 96 (FIG. 1). Thus, correction values for bi-directional printing misalignment are set associated with respective bi-directional printing modes and stored in the EEPROM 200 in the printer 20.

Figure 8:
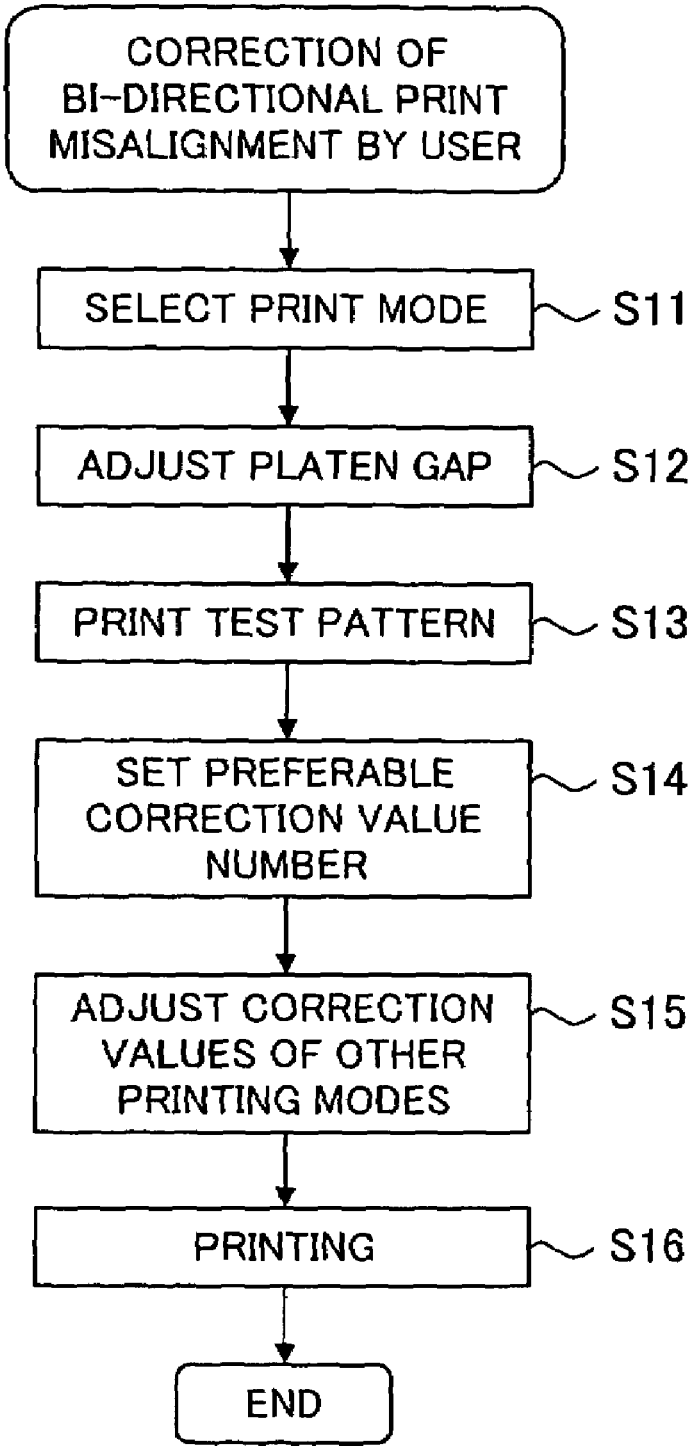
FIG. 8 is a flow chart illustrating a process of correcting bi-directional printing misalignment by users.
Figure 9:
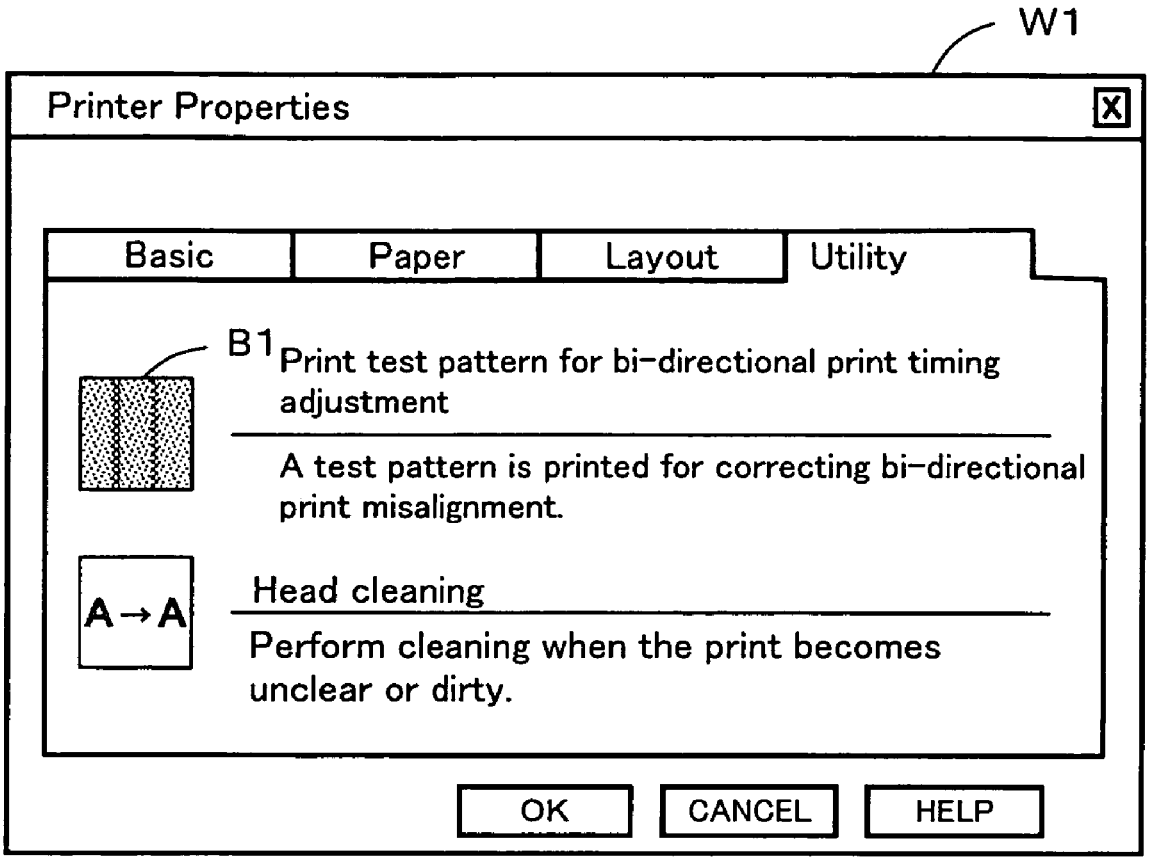
FIG. 9 is an exemplified schematic diagram illustrating a user interface window W1 that allows a user to issue a printing instruction of a test pattern.

FIG. 8 is a flow chart illustrating a process of correcting bi-directional printing misalignment by the user. Once the user selects bi-directional printing mode in step S11, the printer 20 automatically performs adjustment of the platen gap according to the selected bi-directional printing mode in step S12. In step 13, a test pattern suitable for the bi-directional printing mode is printed out in response to a user instruction. FIG. 9 is an exemplified schematic diagram illustrating a user interface window W1 that allows a user to issue a printing instruction of a test pattern. This window W1 is a utility window in Printer properties in which a button B1 is installed to input the printing instruction of a test pattern for adjusting the timing of bi-directional printing. When the user clicks the button B1, the test pattern supply module 103 (FIG. 1) reads out the test pattern signal TPS from the hard disk 92 and transmits the signal to the printer 20, which then prints a test pattern responsive to the signal. This test pattern may be the same test pattern as the one applied to correct bi-directional misalignment before shipping (FIG. 6), or may be a different one. In this embodiment, the test pattern shown in FIG. 6 is used again to correct bi-directional printing misalignment by the user.

Figure 10:
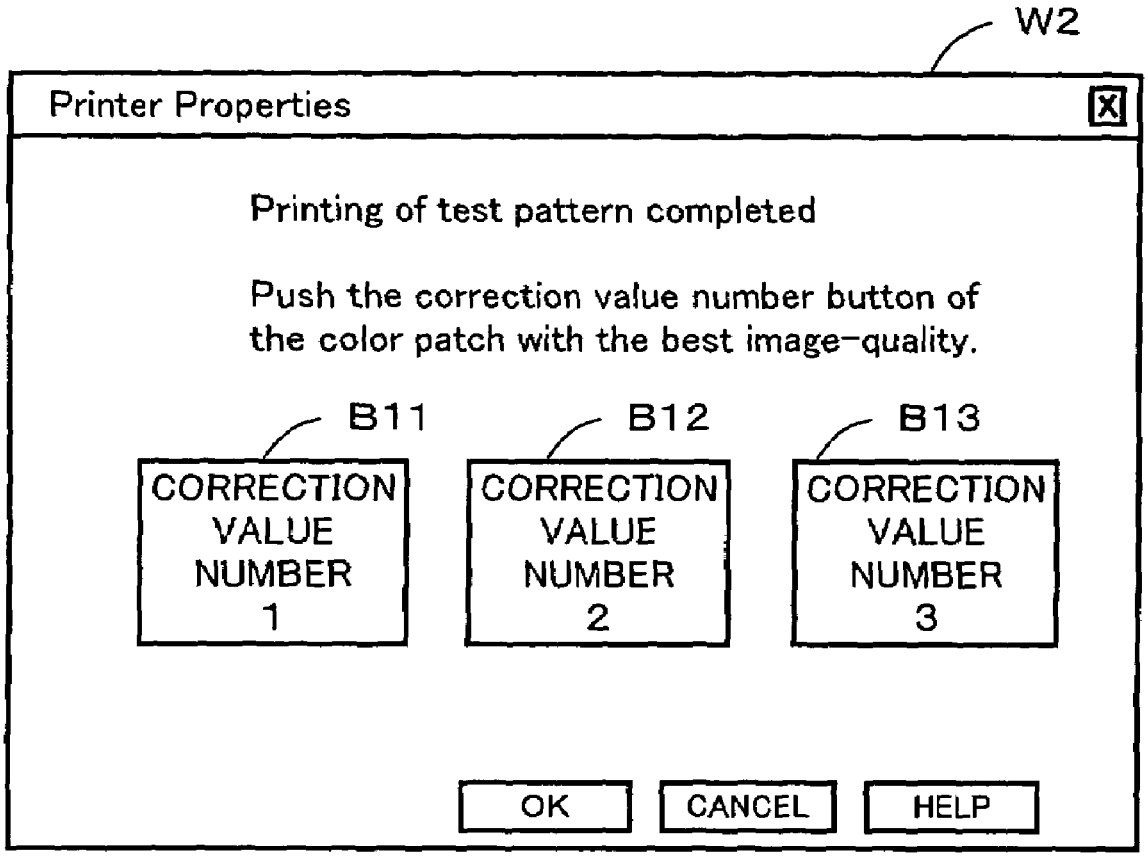
FIG. 10 is an exemplified schematic diagram illustrating a user interface window W2 that allows a user to set correction value number.

In step S14 in FIG. 8, the color patch with the highest image quality is selected among a plurality of printed color patches, so as to set the corresponding correction value number. FIG. 10 is an exemplified schematic diagram illustrating a user interface window W2 that allows a user to set a preferable correction value number. This window W2 is automatically displayed by the user interface display module 101 (FIG. 1) when the test pattern is printed out. This window W2 contains a plurality of buttons B11–B13 for selecting a preferable correction value number. When the user clicks on any one of these buttons B11–13, the correction value δ corresponding to the preferable correction value number is stored in the EEPROM 200 (FIG. 3) in the printer 20. This correction value may be stored in the EEPROM 200 as replacement for the reference correction value determined in step S4 of FIG. 5, or another value for correcting the reference correction value may be stored in the EEPROM 200 in addition to the reference correction value. Furthermore, the correction value that has been set by the user may be stored in the printer driver 96 instead of the EEPROM 200.

In step S15, the positional deviation correction section 212 (FIG. 3) adjusts correction values for other bi-directional printing modes, if necessary. FIG. 11 shows this correction value adjustment. In this example, the correction value δG1m1 for the first bi-directional printing mode is changed to new correction value δG1m1' by the user. Here, correction values for other bi-directional printing modes which have a common platen gap PG and a common carriage speed with the first one are adjusted according to the following expressions.

$$\delta G1c1' = \delta G1c1 + (\delta G1m1' - \delta G1m1)$$

$$\delta G1c2' = \delta G1m2 + (\delta G1m1 - \delta G1m1)$$

$$\delta G1c2' = \delta G1c2 + (\delta G1m1 - \delta G1m1)$$

In other words, correction values δG1c1, δG1m2 and δG1c2 for other three bi-directional printing modes, each of which has identical values of the platen gap PG and the carriage speed with the first bi-directional printing mode, are adjusted by the variation of correction value (δG1m1'–δG1m1) for the first bi-directional printing mode. The process of such adjustment enables resetting of proper correction values for as many printing modes as possible even when the user resets correction values based on the test pattern for not all bi-directional printing modes. The targeted printing modes to be adjusted are limited to those modes to which both the platen gap PG and the carriage speed are common because bi-directional printing misalignments significantly depend on those parameters in many cases. The above process substantially ensures high precision adjustment of correction values in bi-directional printing modes to which both the platen gap PG and the carriage speed are common. However, other specific bi-directional printing modes may also be adjusted according to this manner. In another example, the correction value adjustment in step S15 may not be performed at all.

In step S16 of FIG. 8, the actual printing is performed in response to the user instruction. Here, the circuit shown in FIG. 3 controls ink ejection operation of the print head 62, according to the correction value set in step S 14.

As mentioned above, in the first embodiment, correction values δ for bi-directional printing misalignment are prestored in the EEPROM 200 associated with a plurality of bi-directional printing modes, and thus appropriate correction of bi-directional printing misalignment is attained by applying the correction value δ that is suitable for the bi-directional printing mode in actual printing. Furthermore, these correction values are set based on printing of a test pattern suitable for each mode, and thus ensure enhanced correction of bi-directional printing misalignments with higher accuracy, compared with the case where the correction value of each printing mode is calculated with mathematical operation, such as interpolation, based on a small number of correction values.

The first embodiment has another advantage that, when the correction value for one bi-directional printing mode is changed by the user, correction values for other specific bi-directional printing modes are also changed accordingly, thereby attaining proper adjustment of the correction values for bi-directional printing misalignment with less manual labor.

Figure 12:
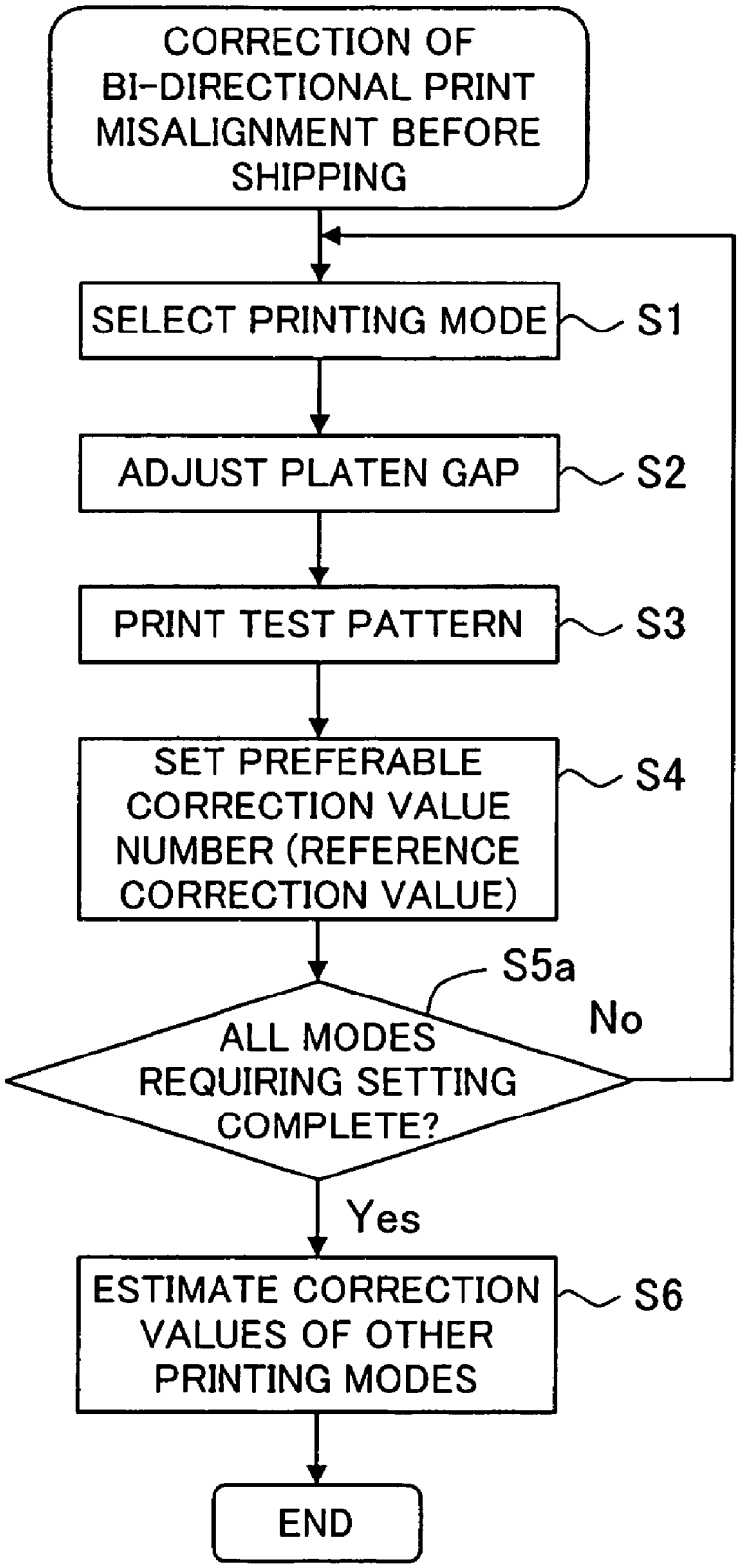
FIG. 12 is a flow chart illustrating a process of correcting bi-directional printing misalignment before the printer 20 is shipped in accordance with the second embodiment.

C. Second Embodiment of Positional Deviation Correction in Bi-directional Printing FIG. 12 is a flow chart illustrating a process of correcting bi-directional printing misalignment before the printer 20 is shipped in accordance with the second embodiment. Most of the process in FIG. 12 is the same with that in FIG. 5, except for step S5*a*, which substitutes for step S5 of FIG. 5 in the first embodiment, and step S6, which is newly added.

In step S5*a*, it is judged whether or not all steps S1–S4 have been completed for all of those bi-directional printing modes for which the correction value is required to be set based on the test pattern. In the second embodiment, the test pattern is printed out not for all bi-directional printing modes, but for some limited bi-directional printing modes. In step S6, estimation of a correction value for bi-directional printing misalignment based on the correction value that has been set is carried out with respect to the other bi-directional printing modes in which the correction value has not been set based on a test pattern.

FIG. 12 is an exemplified schematic diagram illustrating how to estimate the correction value for bi-directional printing misalignment in the second embodiment, which is equivalent to FIG. 4 in the first embodiment. In this example, correction values for the eighth and tenth bi-directional printing modes δG1c2 and δG2c2 are respectively calculated by the estimation based on other correction values, as specifically shown in the following expressions.

$$\delta G2c1=\delta G1c1+(\delta G2m1-\delta G1m1)$$

$$\delta G2c2=\delta G1c2+(\delta G2m2-\delta G1m2)$$

The correction value δG2c1 for the eighth bi-directional printing mode is estimated by adding a difference between the correction values resulted from the variation in the platen gap PG in monochrome printing (δG2m1−δG1m1) to the correction value δG1c1 for another bi-directional printing mode in which the print resolution, carriage speed and monochrome/color settings are the same with the eighth mode but the platen gap value PG is different. Similarly, the correction value of the tenth bi-directional printing mode δG2c2 is also estimated by adding a difference between the correction values resulted from the variation in the platen gap PG in monochrome printing (δG2m1−δG1m1) to the correction value δG1c2 for another bi-directional printing modes in which the print resolution, carriage speed and monochrome/color settings are the same with the tenth mode but the platen gap value PG is different. Thus, the difference between the correction values resulted from the variation in the platen gap PG in monochrome print (δG2m1−δG1m1) is utilized as an adjustment value for estimating the correction value.

In the second embodiment, test patterns are used to set respective correction values δ for the first through sixth bi-directional printing modes, in which the values of the platen gap PG are relatively small. This is because expensive print medium is generally used in the bi-directional printing mode in which the platen gap PG is relatively small and the picture quality is likely to be more emphasized. On the other hand, the picture quality is likely to be less emphasized in the printing mode in which the platen gap PG is relatively large. Accordingly, it is acceptable to estimate a correction value for a bi-directional printing mode with larger platen gap PG by applying a correction value for another bi-directional printing mode with a smaller platen gap value, from a practical standpoint of the picture quality.

The estimation of correction value does not need to be performed at the time of storing the correction values in the EEPROM 200, but may be performed when actual printing using the correction value is to be carried out. The latter case enables the positional deviation correction section 212 (FIG. 3) to perform the above-mentioned estimation when printing is to be carried out without storing the correction values, for example, for the eighth and tenth printing modes of FIG. 13 in the EEPROM 200. In general, it may be sufficient to store in the EEPROM 200 respective correction values for at least two bi-directional printing modes corresponding to at least part of a plurality of bi-directional printing modes, so that the positional deviation correction section 212 can select a positional deviation correction value for the bi-directional printing mode that is actually used.

This arrangement of the second embodiment enables the correction values for part of bi-directional printing modes to be set not based on the test pattern but based on the estimation using correction values for other bi-directional printing modes, and thus facilitates the setting of the correction values.

D. Modifications

The present invention is not restricted to the above examples or embodiments, but there may be many other aspects without departing from the scope or spirit of the present invention. Some examples of possible modification are given below.

D1. Modification 1

The present invention is not restricted to color ink jet printers as described in the above embodiments, but may also be applied to monochrome printers, or even to non-ink-jet printers. The present invention is generally applicable to a printing apparatus that prints images on a print medium, such as a facsimile machine and a copying machine, for example.

D2. Modification 2

In the above embodiments, correction values for bi-directional printing misalignment are stored in the EEPROM 200 in the printer, but they may be stored in a nonvolatile memory placed in any location in the printing system.

D3. Modification 3

In the above embodiments, the platen gap is adjusted according to the type of the print medium, but it may be adjusted according to other conditions.

D4. Modification 4

In the above embodiments, the platen gap is adjusted by moving the print head, but it may be adjusted by moving the platen itself. The platen gap adjuster of the present invention may generally adjust the amount of the platen gap by moving at least one of the print head and the platen relative to the other.

D5. Modification 5

In the above embodiments, correction values for bi-directional misalignment are set depending on print parameters other than the platen gap. Alternatively, it is possible to set those correction values for bi-directional printing misalignment depending only on the platen gap. In other words, it may be sufficient to set mutually different correction values for bi-directional printing misalignment with respect to a plurality of platen gap values.

D6. Modification 6

Although parameters such as the type of the print medium, selection from monochrome printing and color printing, selection from uni-directional printing and bi-directional printing, and the print resolution are used to define the printing condition in the above embodiments, other types of parameters may also be used. One available example of such parameter for the printing condition includes the type of a driving waveform that is used for the printer in which various types of driving waveforms are applicable to the print head.

Although the present invention has been described and illustrated in detail, these descriptions and illustrations are illustrative and not restrictive, but the spirit and scope of the present invention are limited only by the appended claims.

What is claimed is:

1. A method for correcting positional deviation of ink dots arising from bi-directional printing with a printing apparatus, the printing apparatus including a print head and a platen having a platen gap, which is a gap between the print head and the platen, the platen gap being adjustable to a plurality of values, the method comprising the steps of:

(a) providing different positional deviation correction values for the plurality of values of the platen gap, the positional deviation correction values being to be used for correcting positional deviation of ink dots in bi-directional printing; and (b) selecting a positional deviation correction value according to the value of the platen gap, and correcting positional deviation of ink dots in bi-directional printing using the selected positional deviation correction value, wherein the printing apparatus is capable of carrying out printing under each of a plurality of printing conditions each defined by a combination of a plurality of parameters including at least the value of the platen gap and a print resolution, wherein the step (a) comprises providing respective positional deviation correction values for at least two printing conditions corresponding to at least part of the plurality of printing conditions, and wherein the step (b) comprises determining a positional deviation correction value according to the combination of the plurality of parameters in bi-directional printing.

2. A method according to claim 1, further comprising the step off printing test patterns usable for determining positional deviation correction values for the at least two printing conditions, wherein the step (b) comprises the steps of:

i) using a first positional deviation correction value that is read out from a storage in the printing apparatus when performing the bi-directional printing under a printing condition where the platen gap is set to a relatively small first value, the first positional deviation correction value being determined by using the test pattern for determining the positional deviation correction value under the printing condition; and ii) using a second positional deviation correction value when performing the bi-directional printing under another printing-condition where the platen gap is set to a relatively large second value, the second positional deviation correction value being determined by adjusting the first positional deviation correction value with an adjustment value representing a difference of the positional deviation correction values in two cases where the platen gap is set to the relatively small first value and to the relatively large second value, respectively.

3. A method for correcting positional deviation of ink dots arising from bi-directional printing with a printing apparatus, the printing apparatus including a print head and a platen having a platen gap, which is a gap between the print head and the platen, the platen gap being adjustable to a plurality of values, the method comprising the steps of:

(a) providing different positional deviation correction values for the plurality of values of the platen gap, the positional deviation correction values being to be used for correcting positional deviation of ink dots in bi-directional printing; and (b) selecting a positional deviation correction value according to the value of the platen gap, and correcting positional deviation of ink dots in bi-directional printing using the selected positional deviation correction value, wherein the step (a) comprises the step of providing respective positional deviation correction values for a plurality of printing conditions which have a same value of the platen gap and different values of another parameter, and wherein the step (b) comprises the step of, when a positional deviation correction value for a first printing condition among the plurality of the printing conditions is varied, varying the positional deviation correction value for another printing condition which has the same values of the platen gap and main scan speed with the first printing condition, with a variation amount of the positional deviation correction value for the first printing condition.

4. A printing apparatus capable of bi-directional printing and having a print head and a platen, the printing apparatus comprising:

a platen gap adjuster that is capable of adjusting a platen gap to a plurality of values, the platen gap being a gap between the print head and the platen;

a storage that stores different positional deviation correction values for the plurality of values of the platen gap, the positional deviation correction values being to be used for correcting positional deviation of ink dots in bi-directional printing; and a positional deviation correction section that selects a positional deviation correction value according to the value of the platen gap, and corrects the positional deviation of ink dots in bi-directional printing using the selected positional deviation correction value, wherein the printing apparatus is capable of carrying out printing under each of a plurality of printing conditions each defined by a combination of a plurality of parameters including at least the value of the platen gap and a print resolution, wherein the storage stores respective positional deviation correction values for at least two printing conditions corresponding to at least part of the plurality of printing conditions, and wherein the positional deviation correction section determines a positional deviation correction value according to the combination of the plurality of parameters in bi-directional printing.

5. A printing apparatus according to claim 4, further comprising:

a test pattern printing section that prints test patterns usable for determining positional deviation correction values for the at least two printing conditions, wherein the positional deviation correction section comprises:

i) using a first positional deviation correction value that is read out from the storage when performing bi-directional printing under a printing condition where the platen gap is set to a relatively small first value, the first positional deviation correction value being determined by using the test pattern for determining the positional deviation correction value under the printing condition; and ii) using a second positional deviation correction value when performing bi-directional printing under another printing condition where the platen gap is set to a relatively large second value, the second positional deviation correction value being determined by adjusting the first positional deviation correction value with an adjustment value representing a difference of the positional deviation correction values in two cases where the platen gap is set to the relatively small first value and to the relatively large second value, respectively.

6. A printing apparatus capable of bi-directional printing and having a print head and a platen, the printing apparatus comprising:

a platen gap adjuster that is capable of adjusting a platen gap to a plurality of values, the platen gap being a gap between the print head and the platen;

a storage that stores different positional deviation correction values for the plurality of values of the platen gap, the positional deviation correction values being to be used for correcting positional deviation of ink dots in bi-directional printing;

a positional deviation correction section that selects a positional deviation correction value according to the value of the platen gap, and corrects the positional deviation of ink dots in bi-directional printing using the selected positional deviation correction value; and wherein the storage stores respective positional deviation correction values for a plurality of printing conditions which have a same value of the platen gap and different values of another parameter, and when a positional deviation correction value for a first printing condition among the plurality of the printing conditions is varied, the positional deviation correction section varies the positional deviation correction value for another printing condition which has the same values of the platen gap and main scan speed with the first printing condition, with a variation amount of the positional deviation correction value for the first printing condition.

7. A computer program product for controlling bi-directional printing with a printing apparatus, the printing apparatus comprising a printing head, a platen, and a platen gap adjuster that is capable of adjusting a platen gap to a plurality of values, the platen gap being a gap between the print head and the platen the computer program product comprising a computer readable medium; and a computer program stored on the computer readable medium, the computer program comprising:

a first program that causes a computer to select a positional deviation correction value from a storage, the storage storing different positional deviation correction values for the plurality of values of the platen gap, the positional deviation correction values being to be used for correcting positional deviation of ink dots in bi-directional printing; and a second program that causes the computer to correct positional deviation of ink dots in bi-directional printing using the selected positional deviation correction value; and wherein the printing apparatus is capable of carrying out printing under each of a plurality of printing conditions each defined by a combination of a plurality of parameters including at least the value of the platen gap and a print resolution, wherein the first program has the function of providing respective positional deviation correction values for at least two printing conditions corresponding to at least part of the plurality of printing conditions, and wherein the second program has the function of determining a positional deviation correction value according to the combination of the plurality of parameters in bi-directional printing.

8. A computer program product according to claim 7, further comprising:

a third program that causes the computer and the printing apparatus to print test patterns usable for determining positional deviation correction values for the at least two printing conditions, wherein the second program has the functions of:

i) using a first positional deviation correction value that is read out from the storage when performing bi-directional printing under a printing condition where the platen gap is set to a relatively small first value, the first positional deviation correction value being determined by using the test pattern for determining the positional deviation correction value under the printing condition; and ii) using a second positional deviation correction value when performing bi-directional printing under another printing condition where the platen gap is set to a relatively large second value, the second positional deviation correction value being determined by adjusting the first positional deviation correction value with an adjustment value representing a difference of the positional deviation correction values in two cases where the platen gap is set to the relatively small first value and to the relatively large second value, respectively.

9. A computer program product for controlling bi-directional printing with a printing apparatus, the printing apparatus comprising a printing head, a platen, and a platen gap adjuster that is capable of adjusting a platen gap to a plurality of values, the platen gap being a gap between the print head and the platen the computer program product comprising a computer readable medium; and a computer program stored on the computer readable medium, the computer program comprising:

a first program that causes a computer to select a positional deviation correction value from a storage, the storage storing different positional deviation correction values for the plurality of values of the platen gap, the positional deviation correction values being to be used for correcting positional deviation of ink dots in bi-directional printing; and a second program that causes the computer to correct positional deviation of ink dots in bi-directional printing using the selected positional deviation correction value; and wherein the storage stores respective positional deviation correction values for a plurality of printing conditions which have a same value of the platen gap and different values of another parameter, and when a positional deviation correction value for a first printing condition among the plurality of the printing conditions is varied, the second program varies the positional deviation correction value for another printing condition which has the same values of the platen gap and main scan speed with the first printing condition, with a variation amount of the positional deviation correction value for the first printing condition.

* * * * *